US007986061B2

(12) United States Patent
Kuntze et al.

(10) Patent No.: US 7,986,061 B2
(45) Date of Patent: Jul. 26, 2011

(54) ELECTRICAL SWITCHING DEVICE

(75) Inventors: Torsten Kuntze, Dohna (DE); Carsten Protze, Dresden (DE); Dirk Schräder, Dörnfeld/Ilm (DE)

(73) Assignee: Siemens Aktiengesekkschaft, Munich (DE)

( * ) Notice: Subject to any disclaimer, the term of this patent is extended or adjusted under 35 U.S.C. 154(b) by 368 days.

(21) Appl. No.: 12/280,251

(22) PCT Filed: Feb. 16, 2007

(86) PCT No.: PCT/EP2007/051499

§ 371 (c)(1), (2), (4) Date: Aug. 21, 2008

(87) PCT Pub. No.: WO2007/096302

PCT Pub. Date: Aug. 30, 2007

(65) Prior Publication Data

US 2009/0020506 A1 Jan. 22, 2009

(30) Foreign Application Priority Data

Feb. 22, 2006 (DE) ..... 10 2006 008 933

(51) Int. Cl.
*H01H 7/00* (2006.01)

(52) U.S. Cl. ..... 307/141; 307/113

(58) Field of Classification Search ..... 307/113, 307/141

See application file for complete search history.

(56) References Cited

U.S. PATENT DOCUMENTS

| | | | | |
|---|---|---|---|---|
| 4,376,271 | A * | 3/1983 | Gallatin et al. | 335/159 |
| 5,070,252 | A * | 12/1991 | Castenschiold et al. | 307/64 |
| 5,276,286 | A | 1/1994 | Demissy et al. | |
| 6,570,272 | B2 * | 5/2003 | Dickhoff | 307/113 |
| 7,791,224 | B2 * | 9/2010 | Hober et al. | 307/113 |

FOREIGN PATENT DOCUMENTS

| | | | |
|---|---|---|---|
| DE | 2522525 | A1 | 12/1976 |
| DE | 19918077 | C1 | 11/2000 |
| RU | 2117351 | C1 | 8/1998 |

OTHER PUBLICATIONS

German Office Action dated Sep. 15, 2008.

* cited by examiner

*Primary Examiner* — Jared J Fureman
*Assistant Examiner* — Adi Amrany
(74) *Attorney, Agent, or Firm* — Laurence A. Greenberg; Werner H. Stemer; Ralph E. Locher

(57) ABSTRACT

An electrical switching device has a first interrupter unit for interrupting and connecting an electrical line, in particular an air-insulated grounding switch. A method for switching an air-insulated grounding switch assures that no arc owing to a voltage flashover is produced on the air-insulated grounding switch. A second interrupter unit, which is connected in parallel with the first interrupter unit, can be switched such that resultant striking of an arc during switching only takes place in the second interrupter unit.

16 Claims, 2 Drawing Sheets

ELECTRICAL SWITCHING DEVICE

BACKGROUND OF THE INVENTION

Field of the Invention

The invention relates to an electrical switching device having a first interrupter unit for interruption and connection of an electrical line, in particular an air-insulated grounding switch. The invention also relates to a method for switching an air-insulated grounding switch, in which no arc is struck on the air-insulated grounding switch as a result of a voltage flashover or contact disconnection.

Conventional air-insulated grounding switches are in the form of pivoting grounding devices or pivoting/linear-movement grounding devices. When a line or a switchgear assembly is connected to ground potential or is disconnected from ground potential, these connection processes produce a capacitive and/or an inductive current which can lead to an arc when the main contacts of the grounding switch are at a specific distance from one another. Since grounding switches are generally operated in outdoor installations, this open arc represents a hazard to the people and electrical equipment located in the installation. Until now, this problem has been solved by switching an auxiliary contact with a leading or lagging function with respect to the main contact. Any arc that is formed is struck exclusively on the auxiliary contact. This protects the main contacts of the air-insulated grounding switch against the arc influence. This has the disadvantage that the arc which occurs in this case continues to exist in free space and therefore represents a safety risk.

BRIEF SUMMARY OF THE INVENTION

The object of the present invention is to ensure arc-free switching of a main switch.

The object is achieved by the features of claim 1 and claim 11.

The invention provides that at least one second encapsulated interrupter unit is arranged in parallel with the first interrupter unit in the electrical switching device, and that the voltage flashovers which occur on connection or interruption of the electrical line occur as arcs in the second interrupter unit, with the second interrupter unit being switchable before the first interrupter unit on connection of the electrical line, and being switchable after the first interrupter unit on interruption of the electrical line. The switchgear assembly according to the invention ensures that any possible arc occurs exclusively in the second interrupter unit, and thus that the first interrupter unit is switchable without any arcs. In particular as a first interrupter unit for air-insulated grounding switches, this results in the advantage that any possible arc does not occur on the main contacts of the air-insulated grounding switch, therefore lengthening the life of the switchgear assembly. At the same time, this minimizes the safety risk resulting from the occurrence of an arc on the air-insulated grounding switch as the first interrupter unit in the open air.

In one advantageous refinement of the electrical switchgear assembly, the second interrupter unit is a circuit breaker and/or a load interrupter switch and/or an isolation switch and/or a vacuum interrupter chamber and/or a surge arrester, for example a spark gap and/or a voltage limiter. Particularly when using encapsulated switches as the second interrupter unit, the arc is struck exclusively in the closed chamber of the second interrupter unit, and is therefore shielded from the outside.

According to the invention, an isolation switch is arranged between the first interrupter unit and the second interrupter unit. Particularly in the situation in which the rated short-circuit current for the first interrupter unit is greater than the rated short-circuit current for the second interrupter unit, the second interrupter unit must be isolated from the connected first interrupter unit. This electrical isolation is ensured by the isolation switch.

If the rated short-circuit current of the encapsulated second interrupter unit is equal to or greater than that of the first interrupter unit, the two interrupter units may be arranged in series.

According to the present invention, the second interrupter unit is arranged on the voltage potential side on the switching device, in particular the high-voltage potential side. At least one further interrupter unit for dissipation of overvoltages is arranged in parallel and/or in series with the second interrupter unit. In particular, the third interrupter unit is a surge arrester, a spark gap, open or encapsulated, or some other voltage limiter.

The surge arrester allows the rated voltage of the second interrupter unit to be chosen to be less than the rated voltage of the first switching chamber.

In one advantageous refinement of the switchgear assembly according to the invention, the second interrupter unit is integrated in a fixed contact in an air-insulated grounding switch as the first interrupter unit. This results in the advantage that existing grounding switchgear assemblies can be retrofitted with a corresponding second interrupter unit.

A first part (which is located on a moving main contact) of the isolation switch makes a contact, by means of a holding apparatus, with the second part of the isolation switch. The use of the movement of the moving main contact of the grounding switch as the first interrupter unit allows mechanical/electrical coupling by means of a first part of the isolation switch. An appropriately designed "finger" engages in the holding apparatus and makes a connection on connection and on disconnection by virtue of the movement process of the moving main contact.

The movement of the moving main contact by means of the first part of the isolation switch results in the holding apparatus carrying out a rotary movement. Shortly before reaching the final position for the switched state, the moving main contact carries out a linear movement into the fixed main contact. This movement process of the moving main contact is used to interrupt the existing electrical connection between the two parts of the isolation switch again in the connected state. The vacuum interrupter chamber will previously have been switched by the rotary and linear movement. When the moving main contact is in the final position in the switched state, the second interrupter unit is therefore electrically isolated from the main current path again by the opened isolation switch.

Conversely, during the disconnection movement, the lowering movement of the moving main contact relative to the fixed main contact results in the first part of the isolation switch being brought into contact, via the holding apparatus, with the second part of the isolation switch, thus making an electrical connection via the isolation point first of all. The second interrupter unit is then switched. As the movement of the moving main contact progresses and the distance from the fixed main contact increases, the connection between the fixed and the moving main contact is disconnected without any arc. The first part of the isolation switch is designed such that, when there is an adequate isolation gap between the main contacts, the holding apparatus then makes use of the rotary movement to open the second interrupter unit, for example a vacuum interrupter chamber. Any arc which is created during this process remains in the chamber of the second interrupter unit. Once the contacts of the second interrupter unit have been adequately separated and the arc has been quenched, the isolation switch can likewise be opened with no current flowing. This movement process is ensured by the matched geometry and configuration of the moving main contact, the length and arrangement of the first part of the isolation switch, and the design of the holding apparatus.

The second interrupter unit is advantageously connected in parallel or in series with the first interrupter unit. When the first interrupter unit is electrically connected in series with the second interrupter unit as a series circuit, care must be taken to ensure that the withstand currents of the two interrupter units are each designed for the maximum currents. If the second interrupter unit is arranged in parallel with the first interrupter unit, the withstand current of the second interrupter unit may be chosen to be less than that of the first interrupter unit. In this case, it is then advantageous to use an isolation switch between the first and the second interrupter unit.

The invention likewise proposes a method for switching an air-insulated grounding switch, with the air-insulated grounding switch being connected to a second interrupter unit, which is arranged in parallel with the air-insulated grounding switch, with the second interrupter unit being closed before the air-insulated grounding switch on connection of the electrical line, and with the air-insulated grounding switch being disconnected from the electrical line first of all, and only then followed by the second interrupter unit, on interruption of the electrical line.

When using an isolation point as the connection between the air-insulated grounding switch and the second interrupter unit, the isolation point is closed first during the connection process, after which the second interrupter unit is closed, followed by the air-insulated grounding switch, and the isolation point is opened again when the line connection has been made. The opened isolation point is closed first of all during the disconnection process, after which the air-insulated grounding switch is opened, following which the second interrupter unit is opened, during which process an arc may be produced, and the isolation point is opened again after complete disconnection of the electrical line.

Further advantageous refinements will become evident from the dependent claims. A number of exemplary embodiments will be explained with reference to the figures, in which:

DESCRIPTION OF THE INVENTION

Figure 1:
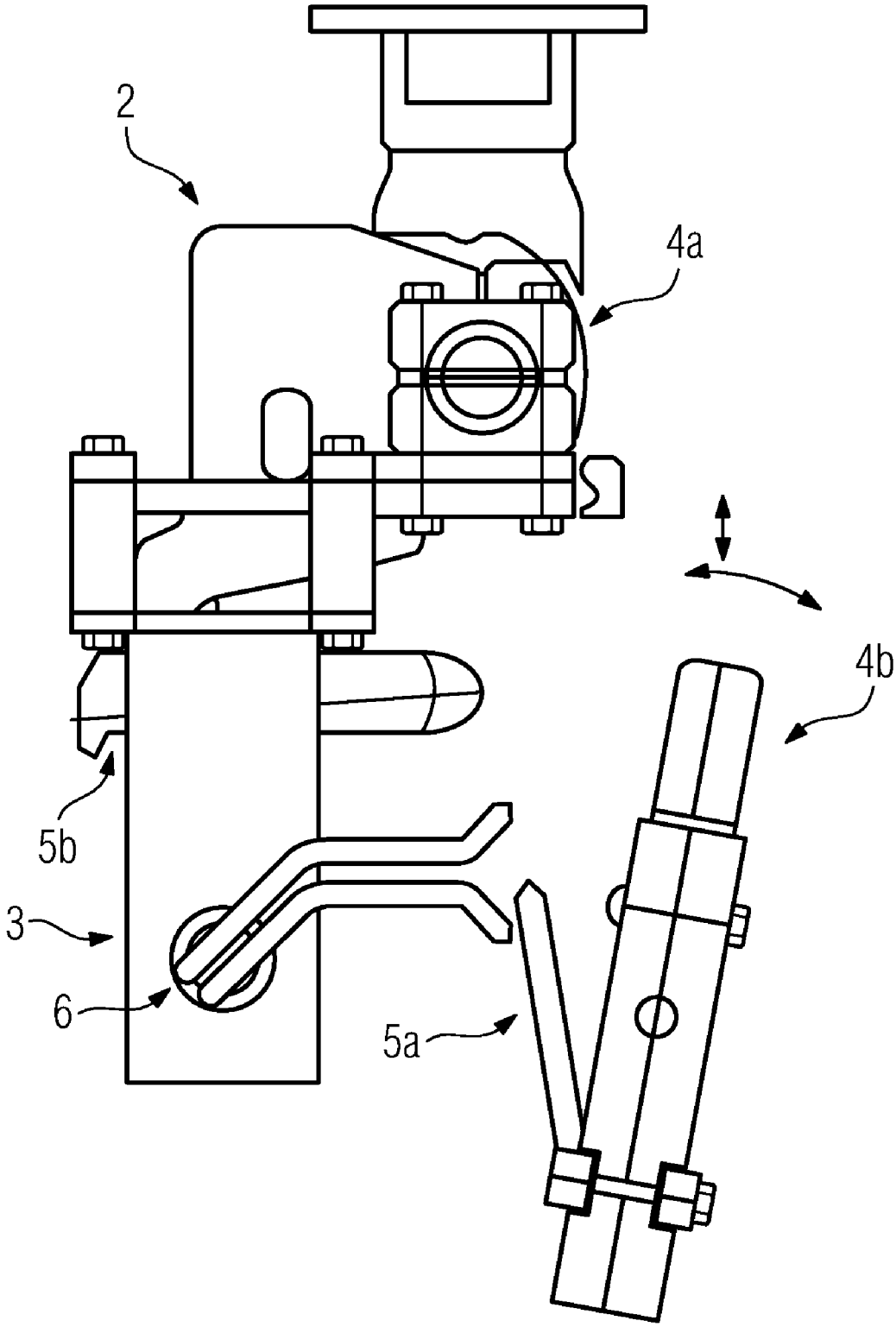
FIG. 1 shows a schematic side view of a part of the switchgear assembly according to the invention.

FIG. 1 shows a schematic side view of an air-insulated grounding switch 2 as a first interrupter unit, as a component of an electrical switching device (not illustrated). A vacuum interrupter chamber 3 is integrated as the second interrupter unit in the fixed main contact 4*a* of the air-insulated grounding switch 2. On closing of the main contacts 4*a*, 4*b* of the grounding switch 2 as the connection of the ground current path to the voltage potential side, the energy of motion of the moving main contact 4*b* of the ground current path is used to close an isolation point 5*a*, 5*b* which is likewise located in the fixed main contact 4*a* of the air-insulated grounding switch 2.

An arm 5*a* on the moving main contact 4*b* latches in the holding apparatus 6 during the rotary movement of the moving main contact 4*b* during the connection process, and thus makes an electrical connection via the isolation point 5*a*, 5*b*. The vacuum interrupter chamber 3 is then likewise closed by the further rotary movement, followed by a linear movement, of the moving main contact 4*b*. Any arc which is created during this process can be quenched within the vacuum interrupter chamber 3. As the movement of the moving main contact 4*b* progresses, an electrical connection is then made, without any arcing, between the fixed main contact 4*a* of the air-insulated grounding switch 2 and the moving main contact 4*b*. At the same time that the moving main contact 4*b* latches into the fixed main contact 4*a* of the air-insulated grounding switch 2 as a result of a vertical movement following the rotary movement of the moving main contact 4*b*, the isolation point 5*a*, 5*b* is opened again by 5*a* moving out of 5*b*, so that the main current path passes exclusively via the air-insulated grounding switch 2. The isolation point 5*a*, 5*b* isolates the vacuum interrupter chamber 3 from the ground current path.

During the disconnection process, the kinematics of the moving main contact 4*b* once again result in the isolation point 5*a*, 5*b* being closed first of all, as a result of the lowering movement of the moving main contact 4*b*. As the distance between the moving main contact 4*b* and the fixed main contact 4*a* of the air-insulated grounding switch increases, the electrical contact now passes exclusively via the vacuum interrupter chamber 3. The vacuum interrupter chamber 3 now also opens the contact and quenches the arc which is created during this process exclusively within the vacuum interrupter chamber 3. As the distance between the moving main contact 4*b* and the fixed main contact 4*a* of the air-insulated grounding switch 2 increases, no arc can now be created between the main contacts 4*a*, 4*b*, so that the air-insulated grounding switch 2 can be closed and opened without any arcing. Once no current is flowing through the air-insulated grounding switch 2 and the vacuum interrupter chamber 3, the isolation point 5*a*, 5*b* is likewise opened by the moving main contact 4*b* moving out, so that the vacuum interrupter chamber 3 and the air-insulated grounding switch 2 are now completely isolated, with no current flowing.

Figure 2:
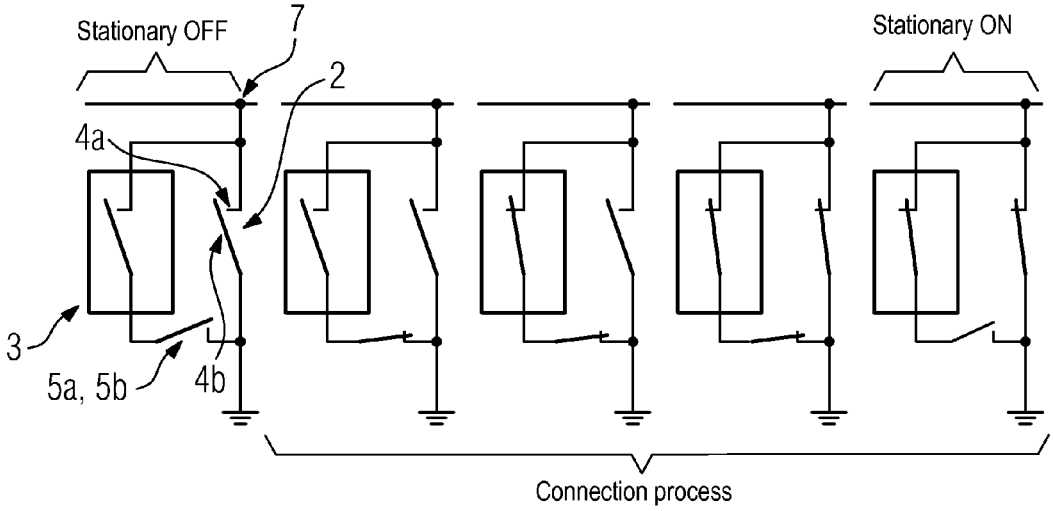
FIG. 2 shows a movement process according to the invention for arc-free connection of an air-insulated grounding switch.

FIG. 2 shows a movement process according to the invention for arc-free connection of an air-insulated grounding switch 2 using an additional isolation point 5*a*, 5*b*. The individual figures show the movement process according to the invention for arc-free switching of the air-insulated grounding switch 2. In the disconnected state, the air-insulated grounding switch 2 and the second interrupter unit 3, as a vacuum switch, as well as an isolation point 5*a*, 5*b* which is arranged between the air-insulated grounding switch 2 and the vacuum interrupter chamber 3, are opened. During the connection process, the isolation point 5*a*, 5*b* is now closed first of all and an electrical connection is then made with the line 7 via the vacuum interrupter chamber 3. Any arc which may be created during this process is quenched within the vacuum interrupter chamber 3. The fixed main contact 4*a* of the air-insulated grounding switch 2 is then closed, and no arc can now be created during this process. With the electrical connection of the main contacts 4*a*, 4*b* of the air-insulated grounding switch 2, the vacuum interrupter chamber 3 is then isolated from the electrical line 7 by means of the isolation point 5*a*, 5*b*.

Figure 3:
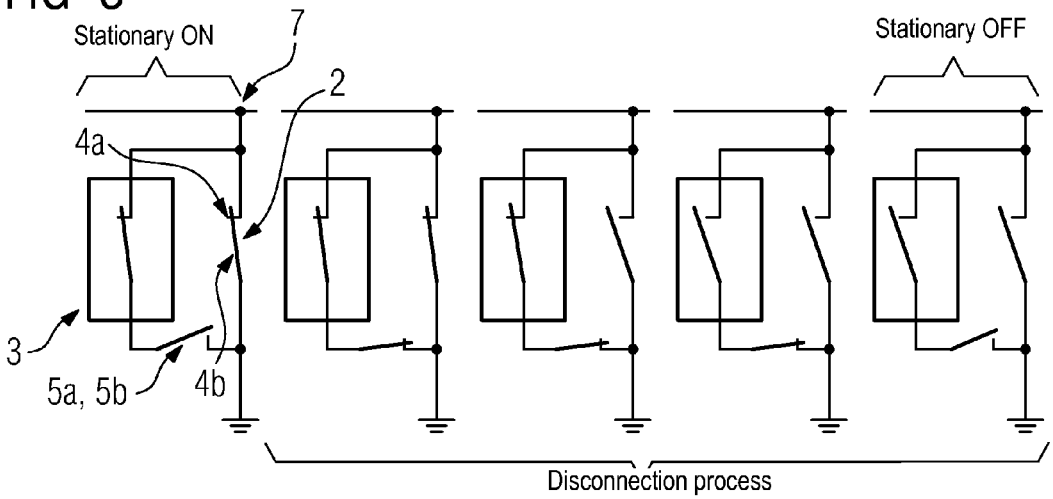
FIG. 3 shows a movement process according to the invention, for arc-free disconnection of an air-insulated grounding switch.

FIG. 3 shows a disconnection process according to the invention for arc-free switching of an air-insulated grounding switch 2 in conjunction with a vacuum interrupter chamber 3 as the second interrupter unit, and an isolation point 5*a*, 5*b*. Once the isolation point 5*a*, 5*b*, having been open in the initial state, has closed, the moving main contact 4*b* of the air-insulated grounding switch 2 is then moved away from the fixed main contact 4*a*. The electrical connection during this phase is made exclusively via the vacuum interrupter chamber 3 as the second interrupter unit. The contacts of the vacuum interrupter chamber 3 are then likewise opened, so that any arc which may be created is struck exclusively in the vacuum interrupter chamber 3. As time passes, the fixed main contact 4*a* of the air-insulated grounding switch 2 is now at such a distance from the moving main contact 4*b* that it is no longer possible for any arc to be struck in the air between the main contacts 4*a*, 4*b*, because of the width of the isolation gap. Once the vacuum interrupter chamber 3 and the main contacts 4*a*, 4*b* of the air-insulated grounding switch 2 have now been disconnected, the isolation point 5*a*, 5*b* is also opened, such that the electrical connection is now disconnected.

In this case, it is advantageous to use the kinematics in the main current path to carry out the corresponding switching process. The movement of the moving main contact 4*b* is used for the force to be applied to close or open the isolation point 5*a*, 5*b* and the vacuum interrupter chamber 3 as the second interrupter unit. In this case, the vacuum interrupter chamber 3 does not require its own power supply, and there is likewise no need for any auxiliary current path in parallel with the grounding device current path.

Figure 4:
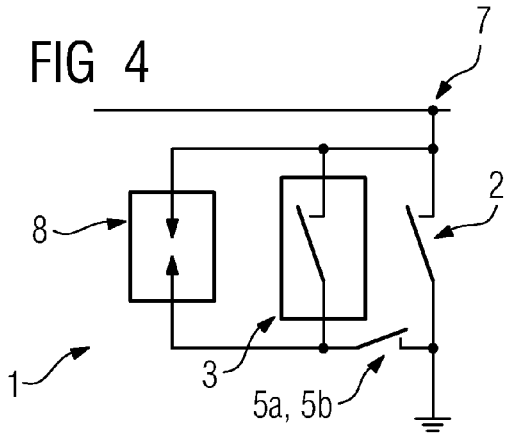
FIG. 4 shows a circuit diagram of the switchgear assembly according to the invention, with a surge arrester arranged in parallel with the second interrupter unit, as the third interrupter unit.

FIG. 4 shows a circuit diagram of the switchgear assembly 1 according to the invention with a surge arrester arranged in parallel with the second interrupter unit 3, as the third interrupter unit 8. The vacuum interrupter chamber 3 which is arranged as the second interrupter unit in parallel with the grounding switch 2 as the first interrupter unit, is additionally protected by the third interrupter unit 8 as a spark gap, with the voltage being limited. This allows the withstand voltage and the withstand current of the vacuum chamber 3 to be less than those of the grounding switch 2. Further interrupter units (not illustrated) can additionally be arranged in parallel and/or in series with the vacuum interrupter chamber 3 in the electrical switchgear assembly 1.

The invention claimed is:

1. An electrical switching device, comprising:

a first interrupter unit for selective interruption and connection of an electrical line, said first interrupter unit being an air-insulated grounding switch;

at least one second interrupter unit connected to said first interrupter unit;

wherein said second interrupter unit is switched before said first interrupter unit on connection of the electrical line and after the first interrupter unit on interruption of the electrical line, and wherein voltage flashovers occurring on connection or interruption of the electrical line occur as arcs in said second interrupter unit.

2. The electrical switching device according to claim 1, wherein said second interrupter unit is at least one switching device selected from the group consisting of a circuit breaker, a load switch, an isolation switch, a vacuum interrupter chamber, and/or a surge arrester.

3. The electrical switching device according to claim 1, which further comprises an isolation switch connected between said first interrupter unit and said second interrupter unit.

4. The electrical switching device according to claim 3, wherein a first part of said isolation switch is disposed to make contact, by way of a holding apparatus, with a second part of said isolation switch.

5. The electrical switching device according to claim 4, wherein said first part of said isolation switch is disposed on a moving main contact.

6. The electrical switching device according to claim 1, wherein said second interrupter unit is connected on a voltage potential side of the switching device.

7. The electrical switching device according to claim 6, wherein said second interrupter unit is connected on a high-voltage potential side of the switching device.

8. The electrical switching device according to claim 1, which further comprises a third interrupter unit for dissipation of overvoltages connected in parallel with said second interrupter unit.

9. The electrical switching device according to claim 8, wherein said third interrupter unit is a surge arrester.

10. The electrical switching device according to claim 1, which further comprises a third interrupter unit for dissipation of overvoltages connected in series with said second interrupter unit.

11. The electrical switching device according to claim 10, wherein said third interrupter unit is a surge arrester.

12. The electrical switching device according to claim 1, wherein said first interrupter unit is a grounding switch having a fixed contact, and said second interrupter unit is integrated in said fixed contact of said grounding switch.

13. The electrical switching device according to claim 1, wherein said second interrupter unit is connected in parallel with said first interrupter unit.

14. The electrical switching device according to claim 1, wherein said second interrupter unit is connected in series with said first interrupter unit.

15. A method for switching an air-insulated grounding switch of an electrical line connected to the grounding switch, which comprises:

providing a second interrupter unit disposed in parallel with the air-insulated grounding switch;

for connecting the electrical line, closing the second interrupter unit before the air-insulated grounding switch; and for disconnecting the electrical line, first disconnecting the air-insulated grounding switch from the electrical line and subsequently disconnecting the second interrupter unit.

16. The method according to claim 15, which comprises providing an isolation point as a connection between the air-insulated grounding switch and the second interrupter unit; and during a connection process, first closing the isolation point and subsequently closing the second interrupter unit, followed by the air-insulated grounding switch, and opening the isolation point after the line connection has been made; and during a disconnection process, first closing the opened isolation point, subsequently opening the air-insulated grounding switch, and subsequently opening the second interrupter unit, during which disconnection process an arc may be produced, and opening the isolation point once more after complete disconnection of the electrical line has been effected.

* * * * *